US009715821B2

(12) United States Patent
Gilson et al.

(10) Patent No.: US 9,715,821 B2
(45) Date of Patent: Jul. 25, 2017

(54) SYSTEM AND METHOD FOR MANAGING DEVICE CONTROLS

(75) Inventors: Ross Gilson, Philadelphia, PA (US); Michael Sallas, Philadelphia, PA (US)

(73) Assignee: Comcast Cable Communications, LLC, Philadelphia, PA (US)

( * ) Notice: Subject to any disclaimer, the term of this patent is extended or adjusted under 35 U.S.C. 154(b) by 673 days.

(21) Appl. No.: 13/555,441

(22) Filed: Jul. 23, 2012

(65) Prior Publication Data

US 2014/0023375 A1 Jan. 23, 2014

(51) Int. Cl.
*G08C 17/02* (2006.01)
*G08C 23/04* (2006.01)

(52) U.S. Cl.
CPC ..... *G08C 17/02* (2013.01); *G08C 23/04* (2013.01); *G08C 2201/21* (2013.01)

(58) Field of Classification Search
CPC ..... G08C 17/02; G08C 23/04
USPC ..... 710/62
See application file for complete search history.

(56) References Cited

U.S. PATENT DOCUMENTS

| | | | | |
|---|---|---|---|---|
| 7,010,805 | B2 * | 3/2006 | Hayes et al. | 725/153 |
| 2006/0277209 | A1 * | 12/2006 | Kral et al. | 707/102 |
| 2008/0122675 | A1 * | 5/2008 | Bilodeau et al. | 341/176 |
| 2008/0123670 | A1 * | 5/2008 | Mundra | H04L 12/66 370/401 |
| 2010/0060418 | A1 * | 3/2010 | Tarizzo | 340/5.83 |
| 2012/0249289 | A1 * | 10/2012 | Freese | G08C 17/00 340/5.7 |

* cited by examiner

*Primary Examiner* — Henry Tsai
*Assistant Examiner* — John Roche
(74) *Attorney, Agent, or Firm* — Ballard Spahr LLP

(57) ABSTRACT

Systems and methods for managing device controls are disclosed. One method can comprise receiving validation information regarding validity of a plurality of command codes and identifying one or more code indices based upon the received validation information. If the one or more of the code indices is a full function match, the one or more of the code indices can be transmitted to the control device. If the one or more of the code indices is a partial function match, supplemental validation information can be requested regarding validity of one or more second command codes.

20 Claims, 11 Drawing Sheets

SYSTEM AND METHOD FOR MANAGING DEVICE CONTROLS

BACKGROUND

Currently, various devices can be configured to control user devices such as televisions, communication terminals, receivers, and the like. Such "control" devices often have a pre-defined number of inputs or buttons, and can be programmed to enable control of various user devices. Encoded data such as command codes or an index of codes for controlling a user device is typically programmed directly on the control device. After a user programs the control device, the user must test the programmed buttons (e.g., hard keys, soft keys, icons, user-engageable elements, etc.) on the control device to ensure the programmed buttons match an associated control function for the content device. If a partial match occurs (e.g., all functions in a selected code index do not match-up to the corresponding functions on an associated user device), the control device may not be able to control all the features available on the content device. Current solutions for managing device controls are cumbersome, confusing, and do not provide sufficient management of control devices and control functions.

SUMMARY

It is to be understood that both the following general description and the following detailed description are exemplary and explanatory only and are not restrictive, as claimed. Provided are methods and systems for managing device controls and control functions associated with a particular device (e.g., content device).

In an aspect, the systems and methods of the present disclosure can utilize an on-screen dynamic setup process. As an example, the dynamic setup process can comprise transmitting signals and/or encoded data over infrared (IR), radio frequency (RF), Bluetooth, WiFi, and other communication protocols to guide the user to a code index from a database of code indices. In an aspect, where a first code index enables a first control function (e.g., mute, power, channel control, volume control, etc.) to be controlled by a control device, an algorithm or other processing can be used to guide the user through a database to identify whether the first code index enables a full control function match for a particular device such as a content device. As an example, a full control function match can comprise identifying a code index that enables the control device to control substantially all of the available control functions associated with a particular content device. However, if no full control function match exists, then an intelligent choice of a partial control function match can be made. As an example, a partial control function match can comprise identifying a code index that enables the control device to control less than all of the available control functions associated with a particular content device. As a further example, a control system can manage the partial control function match in various ways to improve the user experience.

In an aspect, provided are methods that can comprise receiving a first input relating to a first function, requesting a first command code associated with the first function in response to receiving the first input, receiving the first command code, and transmitting a first signal based upon the first command code. One method can further comprise receiving a second input relating to a second function, requesting a second command code associated with the second function in response to receiving the second input, receiving the second command code, transmitting a second signal based upon the second command code, and providing a validation information relating to one or more of the first command code and the second command code.

In an aspect, the methods can comprise determining a first command code, determining a second command code, identifying one or more code indices based upon the presence of at least one of the first command code and the second command code, and validating the one or more code indices.

In an aspect, the methods can comprise determining a first command code, associating the first command code with a first device for executing the first command code, determining a second command code that is not supported by the first device, and associating the second command code with a second device for executing the second command code.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF THE DRAWINGS

The accompanying drawings, which are incorporated in and constitute a part of this specification, illustrate embodiments and together with the description, serve to explain the principles of the methods and systems.

DETAILED DESCRIPTION

Figure 1:
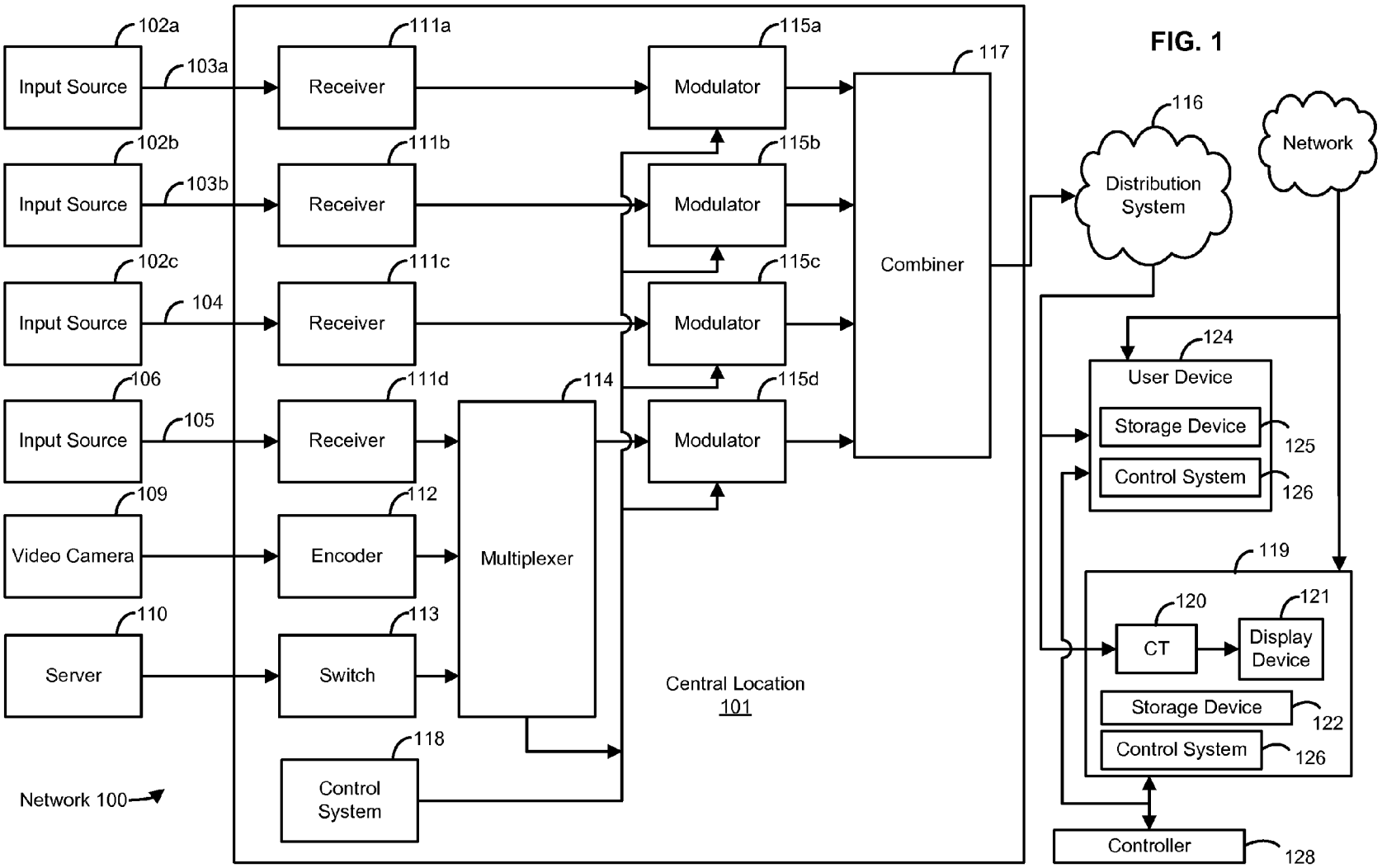
FIG. 1 is a block diagram of an exemplary network.

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the examples included therein and to the Figures and their previous and following description.

As will be appreciated by one skilled in the art, the methods and systems may take the form of an entirely hardware embodiment, an entirely software embodiment, or an embodiment combining software and hardware aspects. Furthermore, the methods and systems may take the form of a computer program product on a computer-readable storage medium having computer-readable program instructions (e.g., computer software) embodied in the storage medium. More particularly, the present methods and systems may take the form of web-implemented computer software. Any suitable computer-readable storage medium may be utilized including hard disks, CD-ROMs, optical storage devices, or magnetic storage devices.

Embodiments of the methods and systems are described below with reference to block diagrams and flowchart illustrations of methods, systems, apparatuses and computer program products. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

In an aspect, a system and network can be configured to analyze one or more of a parameter and operation of a device. In an aspect, one or more of a detected parameter, a detected change in parameter, and a pattern of operation can trigger an alert.

FIG. 1 illustrates various aspects of an exemplary network in which the present methods and systems can operate. The present disclosure relates to systems and methods for analyzing a device. Those skilled in the art will appreciate that present methods may be used in systems that employ both digital and analog equipment. One skilled in the art will appreciate that provided herein is a functional description and that the respective functions can be performed by software, hardware, or a combination of software and hardware.

The network 100 can comprise a central location 101 (e.g., a control or processing facility in a fiber optic network, wireless network or satellite network, a hybrid-fiber coaxial (HFC) content distribution center, a processing center, headend, etc.), which can receive content (e.g., data, input programming, and the like) from multiple sources. The central location 101 can combine the content from the various sources and can distribute the content to user (e.g., subscriber) locations (e.g., location 119) via distribution system 116.

In an aspect, the central location 101 can create content or receive content from a variety of sources 102*a*, 102*b*, 102*c*. The content can be transmitted from the source to the central location 101 via a variety of transmission paths, including wireless (e.g. satellite paths 103*a*, 103*b*) and terrestrial path 104. The central location 101 can also receive content from a direct feed source 106 via a direct line 105. Other input sources can comprise capture devices such as a video camera 109 or a server 110. The signals provided by the content sources can include, for example, a single content item or a multiplex that includes several content items. In an aspect, the central location 101 can create and/or receive application, such as interactive applications. Such applications can be related to a particular content.

The central location 101 can comprise one or a plurality of receivers 111*a*, 111*b*, 111*c*, 111*d* that are each associated with an input source. For example, MPEG encoders such as encoder 112, are included for encoding local content or a video camera 109 feed. A switch 113 can provide access to server 110, which can be a Pay-Per-View server, a data server, an internet router, a network system, a phone system, and the like. Some signals may require additional processing, such as signal multiplexing, prior to being modulated. Such multiplexing can be performed by multiplexer (mux) 114.

The central location 101 can comprise one or a plurality of modulators, 115*a*, 115*b*, 115*c*, and 115*d*, for interfacing to the distribution system 116. The modulators can convert the received content into a modulated output signal suitable for transmission over the distribution system 116. The output signals from the modulators can be combined, using equipment such as a combiner 117, for input into the distribution system 116.

A control system 118 can permit a system operator to control and monitor the functions and performance of network 100. The control system 118 can interface, monitor, and/or control a variety of functions, including, but not limited to, the channel lineup for the television system, billing for each user, conditional access for content distributed to users, and the like. Control system 118 can provide input to the modulators for setting operating parameters, such as system specific MPEG table packet organization or conditional access information. The control system 118 can be located at central location 101 or at a remote location.

The distribution system 116 can distribute signals from the central location 101 to user locations, such as user location 119. The distribution system 116 can be an optical fiber network, a coaxial cable network, a hybrid fiber-coaxial network, a wireless network, a satellite system, a direct broadcast system, or any combination thereof. There can be a multitude of user locations connected to distribution system 116. At user location 119, there may be an interface comprising a decoder 120, such as a gateway or communications terminal (CT) can decode, if needed, the signals for display on a display device 121, such as on a television set (TV) or a computer monitor. Various wireless devices may also be connected to the network at, or proximate, user location 119. Those skilled in the art will appreciate that the signal can be decoded in a variety of equipment, including an CT, a computer, a TV, a monitor, or satellite dish. In an exemplary aspect, the methods and systems disclosed can be located within, or performed on, one or more CT's 120, display devices 121, central locations 101, DVR's, home theater PC's, and the like. As an example, a storage device 122 can be in communication with one or more of the CT 120, the display device 121, and the central location 101 to send/receive content there between. As a further example, the storage device 122 can be located remotely from the user location 119, such as a network storage. In an aspect, a software such as an operating software, control software, or application software can be stored on the storage device 122.

In an aspect, user location 119 is not fixed. By way of example, a user can receive content from the distribution system 116 on a mobile device such as a laptop computer, PDA, smartphone, GPS, vehicle entertainment system, portable media player, and the like.

In an aspect, a user device 124 can receive signals from the distribution system 116 for rendering content on the user device 124. As an example, rendering content can comprise providing audio and/or video, displaying images, facilitating an audio or visual feedback, tactile feedback, and the like. However, other content can be rendered via the user device 124. In an aspect, the user device 124 can be an CT, a set-top box, a television, a computer, a smartphone, a laptop, a tablet, a multimedia playback device, a portable electronic device, and the like. As an example, the user device 124 can be an Internet Protocol compatible device for receiving signals via a network such as the Internet or some other communications network for providing content to the user. It is understood that other display devices and networks can be used. It is further understood that the user device 124 can be a widget or a virtual device for displaying content in a picture-in-picture environment such as on the display device 121, for example. As an example, a storage device 125 can be in communication with one or more of the user device 124 and the central location 101 to send/receive content there between. As a further example, the storage device 125 can be located remotely from the user device 124, such as a network storage medium. In an aspect, a software such as an operating software, control software, or application software can be stored on the storage device 125.

In an aspect, one or more of the CT 120, the user device 124, or other device or system can be in communication with a control system 126 or device or element. The control system 126 can be disposed remotely from one or more of the CT 120 and/or the user device 124 and in communication with one or more devices. As an example, the control system 126 can comprise control software for managing one or more control functions and/or associated encoding. As a further example, the control system 126 can be integrated with one or more of the CT 120, the user device 124, or other device or system.

In an aspect, the control system 126 can be configured to receive, transmit, and/or process encoding such as control codes, code indices, and/or index codes associated with control functions for one or more devices. As an example, the control system 126 can be configured to communicate with a control device or controller 128 to transmit encoding to the controller 128 to enable the controller to control one or more devices. As a further example, the control system 126 can communicate with the controller 128 to evaluate one or more code indices to determine a best match or preferred encoding relating to the control functions associated with a particular device (e.g., CT 120, display device 121, user device 124).

In an aspect, the controller 128 can be a remote controller configured to communicate with one or more devices via wired and/or wireless communication (e.g., radio frequency, infrared, WiFi, Bluetooth, etc.). As an example, the controller 128 can be software executed by a computing device (e.g., mobile device, handheld device, tablet, computer, second screen device, etc.). As a further example, the controller 128 can be any hardware and/or software configured to communicate with a device to control functions associated with the device.

Figure 2A:
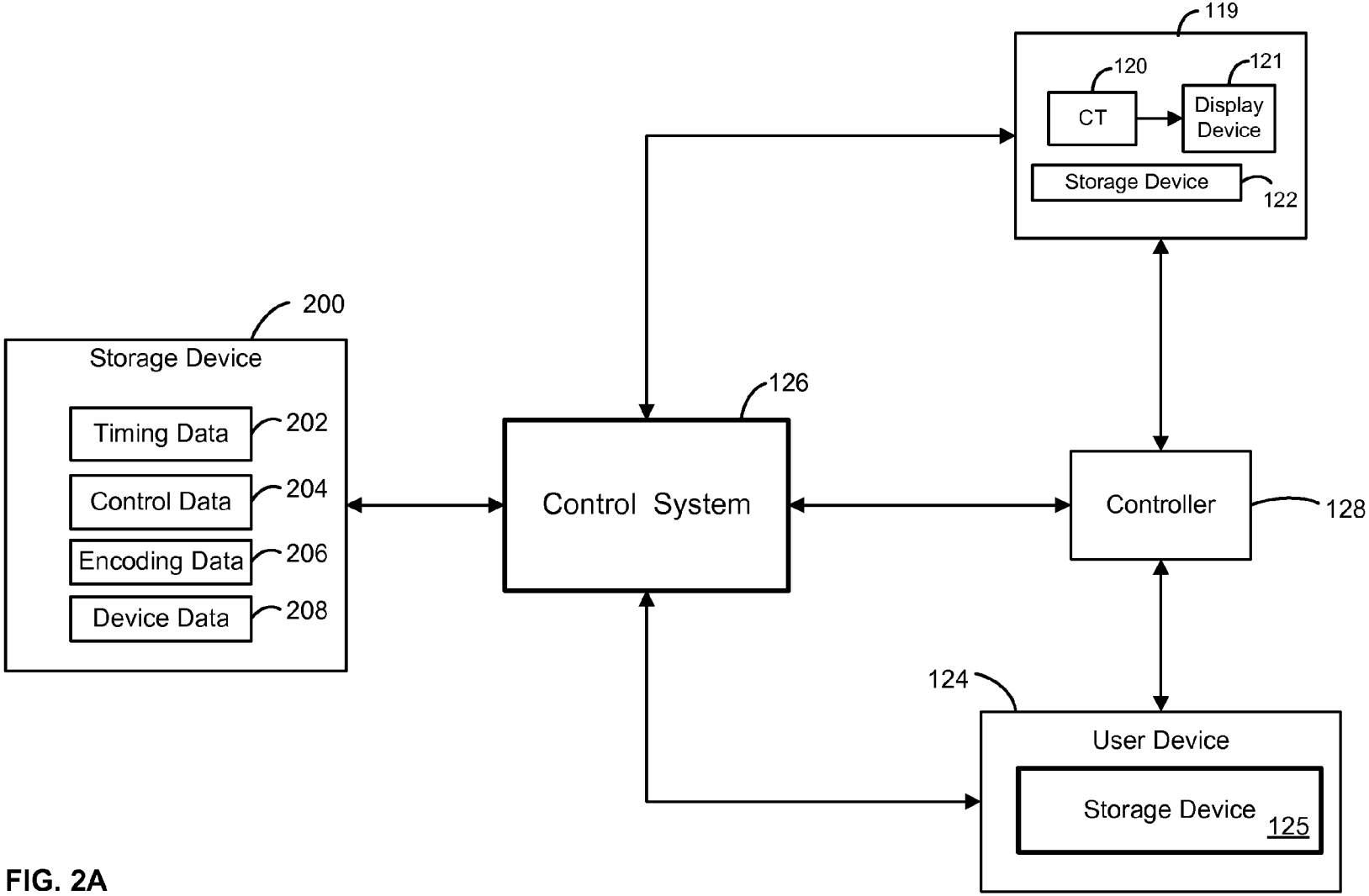
FIG. 2A is a block diagram on an exemplary system and network.

FIG. 2A illustrates various aspects of an exemplary system in which some of the disclosed methods and systems can operate. In an aspect, the control system 126 can be disposed or otherwise implemented remotely from one or more of the CT 120 and/or the user device 124. The system may also be in communication with one or more devices such as the CT 120 and/or the user device 124. As an example, the control system 126 can be disposed in the central location 101. As a further example, the control system 126 can be integrated into a device to manage device control features. In an aspect, the control system 126 can be in communication with the controller 128. As an example, the control system 126 can transmit encoding or instructions to the controller 128 to enable the controller 128 to interact with and/or control a device.

Figure 2B:
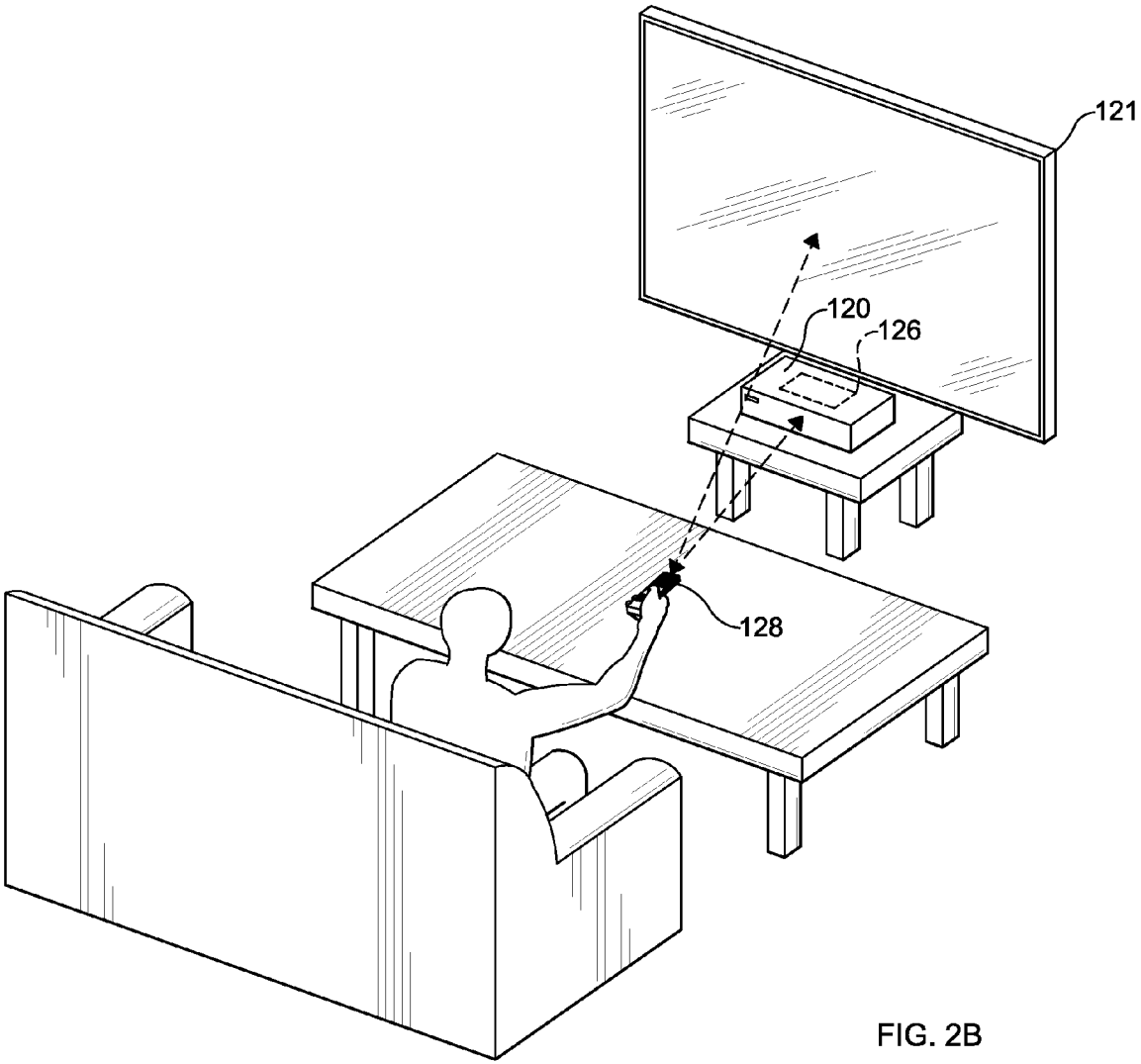
FIG. 2B is a perspective view of an exemplary user environment.

In an aspect, the control system 126 can be disposed in a computing device. As an example, the control system 126 can be a stand-alone system, or may be disposed in one of the CT 120, the user device 124, a set-top box, or a content receiver. As a further example, the control system 126 can be configured to communicate (e.g., wired or wirelessly, unidirectionally or bi-directionally, over RF, IR, WiFi, Bluetooth, and/or other protocols or spectrums) with a controller such as controller 128, as illustrated in FIG. 2B. As shown in FIG. 2B, the remote controller can communicate with a device such as a user interface device (e.g., display device 121, audio device, video device, home security system, etc.). Accordingly, the control system 126 can transmit one or more control codes to the remote control, which can be processed to allow the remote controller to communicate with the user interface device for controlling functions associated with the user interface device. As an example, a user may want to use a single remote controller to control various user interface devices or system. As such, the control system 126 can transmit the requisite command codes to the remote controller to program the remote controller for controlling functions of the various user interface devices.

Returning to FIG. 2A, the control system 126 can be in communication with a storage device 200 or storage medium. The storage device 200 can be disposed remotely from one or more of the control system, the CT 120, the user device 124, and the controller 128. For example, the storage device can be located at central location 101, at a third-party location, and the like. As a further example, the storage device 200 can be integrated or disposed in one or more of the CT 120, the user device 124, and the controller 128. In an aspect, the storage device 200 can be the same storage as storage device 122 or storage device 125.

In an aspect, the storage device 200 can comprise one or more of timing data 202, control data 204, encoding data 206, and/or device data 208. Other data can be stored on and retrieved from the storage device 200.

In an aspect, the timing data 202 can be a time stamp or other time marker for indicating, for example, a date and/or time associated with one or more of a transmission of content, a request for content, a request for playback, storage of content, deletion of content, a request for encoding, encoded data updates, or the execution of a particular control function. As an example, the timing data 202 can comprise any number of time-related entries and/or markers. As a further example, the timing data 202 can comprise one or more of a table of time-related data entries, a timing log, and a database of time-related information. Other information can be stored as the timing data.

In an aspect, the control data 204 can comprise information relating to characteristics and parameters associated with a particular controller and/or controllable functions of one or more devices. In an aspect, the control data 204 can comprise information relating to the buttons or user interface elements of a particular controller. As an example, when a user configures a tablet or touch screen device to operate as a remote controller, the control data can comprise information relating to the communication protocol(s) associated with the tablet and/or the user interface elements rendered on the tablet.

In an aspect, the encoding data 206 can comprise information relating to the programming code required to execute control over one or more functions of a particular device. As an example, the encoding data 206 can comprise one or more code indices and/or macros (e.g., group of commands) or a reference to a command that is already programmed on a controller or device. As a further example, the encoding data 206 can be classified based on manufacturer, model, series, version, device type, modulation and the like.

In an aspect, the device data 208 can comprise information relating to one or more controllable devices. As an example, the device data 208 can comprise information for one or more devices relating to manufacturer, model, series, version, device type, and the like. As a further example, the device data 208 can be associated with the encoding data 206 such that a particular device having a particular manufacturer may be associated with particular encoding data 206. Accordingly, when a user indicates a desire to control a particular device, the control system 126 can locate the encoding data 206 that enables control over the particular device.

Figure 3:
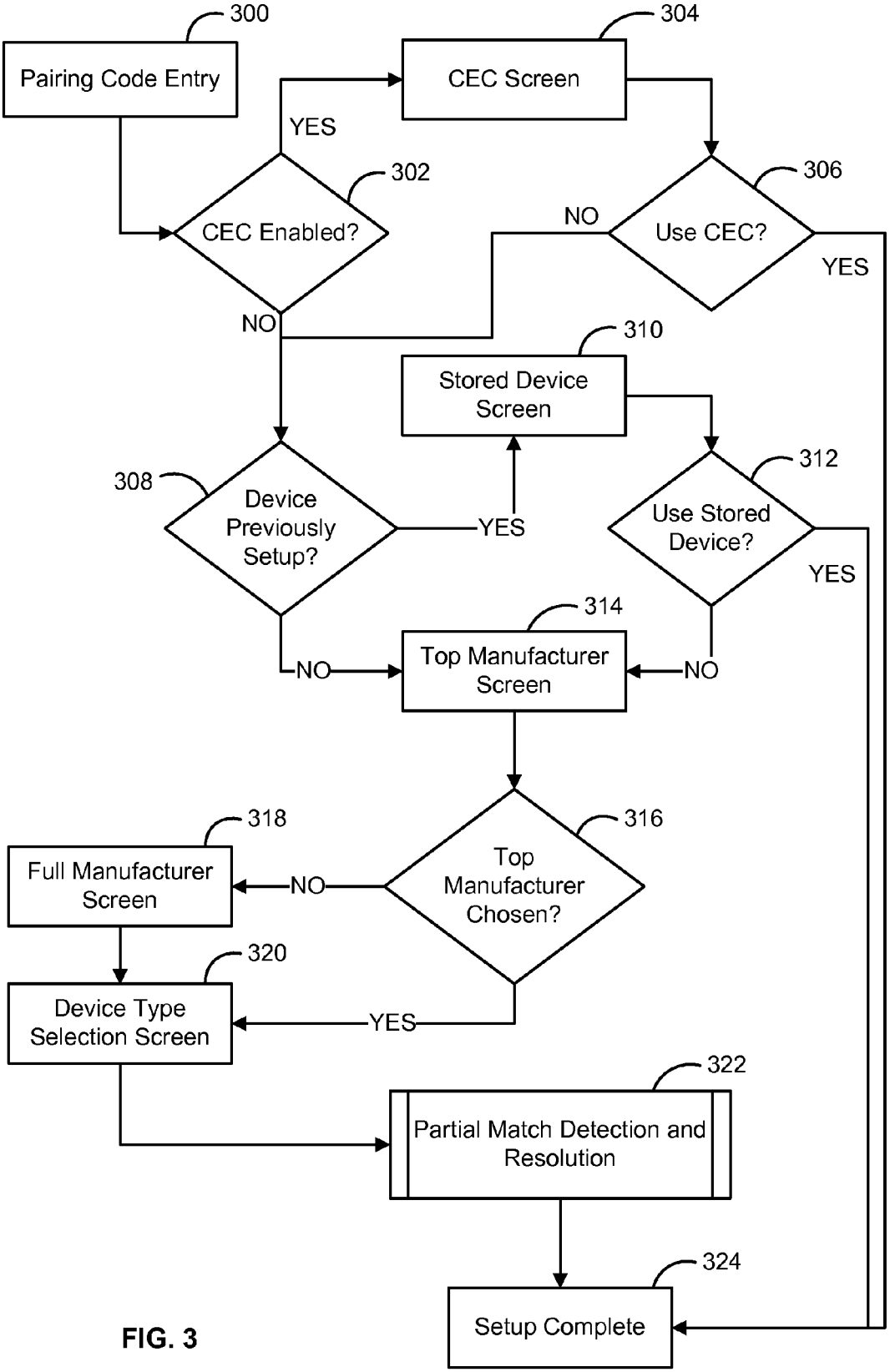
FIG. 3 is a flow chart of an exemplary method.

In an aspect, the methods provided can manage control features of a device. As an example, control codes or code indices can be transmitted to a controller to enable control of one or more control features. FIG. 3 illustrates an exemplary method of managing control features of a device. In an aspect, a database of command codes can be stored locally on a device or remotely accessed by the device. In step 300, a pairing code can be received by the device. As an example, an on screen user interface can be rendered to allow a user to provide a pairing code to associate a controller with the device.

In step 302, the control system (e.g., control system 126) can determine whether a reference or standard, such as, for example, consumer electronics control (CEC), is enabled on the device. In an aspect, any two-way wired or wireless communication can be used with a device, whereby the device can deliver information about itself to the control system 126. As an example, the control system can detect if the device is connected to peripherals, controllers, or other devices via High-definition multimedia interface (HDMI) and/or if the CEC features are supported. If CEC is enabled, a CEC option (e.g., CEC screen 304) can be presented to a user to allow selection of CEC as the control option, at step 306. If CEC is selected, then the control setup can be completed, at step 324. As an example, if CEC is selected, the CEC functions and associated controls can be tested to validate the CEC functions.

If CEC is not enabled or selected, the control system can determine whether a command code has previously been stored for a particular device, at step 308. If the device has previously stored command codes associated therewith, a stored device option (e.g., stored device screen 310) can be presented to a user to allow selection of a stored encoding as the control option, at step 312. If the stored encoding is selected, then the control setup can be completed, at step 324.

If the device is not associated with previously used/stored command codes or the user chooses not to use the stored command codes, the control system can present a list of top manufacturers of devices similar to the device sought to be controlled, at step 314. In step 316, the user can select, or the system can detect, whether a top manufacturer listed matches the manufacturer of the particular device. If the manufacturer of the particular device is not listed as a top manufacturer, a comprehensive or expanded list can be presented to the user at step 318. As an example, a full command code search can be executed regardless of the manufacturer. At step 320, a user can select a particular device type and/or classification of the particular device. As an example, a full command code search can be executed regardless of the device. At step 322, a command code or encoding can be provided to the controller and tested to determine if all control functions are enabled. If a match is confirmed, the matching command code is implemented and the setup can be completed, at step 324. If less than all of the possible control functions of the particular device can be manipulated/controlled by the controller, a partial control function match can be identified. As an example, a partial control function match algorithm can be implemented to resolve the partial control function match. If the partial control function match cannot be resolved, a best match can be implemented, and the setup can be completed, at step 324. As an example, the partial control function match condition can be conveyed to the user. As a further example, the control system can monitor encodings and unusable control functions to update the best match command codes or code index for the particular device to improve the number of control functions enabled by a particular controller and device combination/pairing.

In an aspect, methods can be implemented to manage device controls. As an example, a partial control function match condition between control functions of a particular device and the available user interface elements of a controller can be resolved using algorithms or methods.

Figure 4:
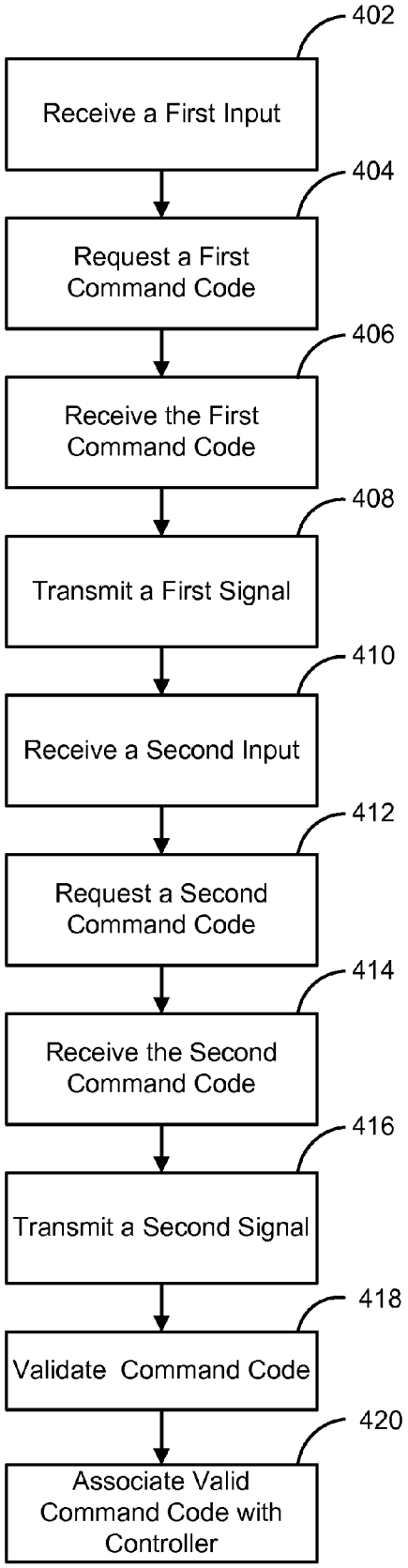
FIG. 4 is a flow chart of an exemplary method.

FIG. 4 illustrates a method for managing control features of a device (e.g., CT 120, user device 124, or other device). In an aspect, in step 402, a first input can be received. As an example, the first input can be received by a controller such as a user-provided input or receipt of a signal input. As a further example, the first input can relate to a first function or control feature of a device. In an aspect, the control function of the device can be related to providing content, such as images or audio, to a user. Other control functions can be associated with the first input.

In step 404, a first command code or encoding can be requested. In an aspect, the first command code can be requested in response to receiving the first input. As an example, the first command code can be associated with the first control function or first control feature of the device. In an aspect, the first control function of the device can be related to providing content, such as images or audio, to a user. Other control functions can be associated with the first command code. As a further example, the first command code can be requested by a controller. In an aspect, the first command code can be a macro (e.g., grouping of command codes), a code index having one or more command codes, or a reference to a command code that is already programmed on the controller remote. The first command code can be transmitted from a database, storage device, user device, terminal, control system 126, or the like, in response to receiving the request for the first command code.

In step 406, the first command code can be received, for example, by a controller. In step 408, a first signal can be transmitted. In an aspect, the first signal can be based upon the first command code. As an example, a controller can transmit the first signal. As a further example, the first signal can be transmitted as a control signal to cause a recipient device to execute the first control function. In an aspect, the first signal is transmitted to facilitate wireless (e.g., RF, IR, WiFi, Bluetooth, and/or other wireless protocol or spectrum) control of a device. In an aspect, any number of inputs (e.g., one or a plurality) can be received.

In step 410, a second input can be received. As an example, the second input can be received by a controller such as a user-provided input or receipt of a signal input. As a further example, the second input can relate to a second control function or control feature of a device. In an aspect, the second input can be the same or different input as the first input. In an aspect, the second control function of the device can be related to providing content, such as images or audio, to a user. Other control features can be associated with the second input.

In step 412, a second command code or encoding can be requested, for example, in response to receiving the second input. As an example, the second command code can be associated with the second control function or control feature of the device. In an aspect, the second control feature of the device can be related to providing content, such as images or audio, to a user. Other control features can be associated with the second command code. As a further example, the second command code can be requested by a controller. In an aspect, the second command code can be a macro (e.g., grouping of command codes or encodings), an code index having one or more command codes, or a reference to a command code that is already programmed on the controller remote. The second command code can be transmitted from a database, storage device, user device, terminal, control system 126, or the like in response to receiving the request for the second command code.

In step 414, the second command code can be received, for example, by a controller. As a further example, In step 416, a second signal can be transmitted, for example, based upon the second command code. As an example, a controller can transmit the second signal. As a further example, the second signal can be transmitted as a control signal to cause a recipient device to execute a control function or feature. In an aspect, the second signal is transmitted to facilitate wireless (e.g., RF, IR, WiFi, Bluetooth, and/or other wireless protocol or spectrum) control of a device.

In step 418, one or more of the first command code and the second command code can be validated. As an example, validation information regarding validity of one or more of the first command code and the second command code can be provided (e.g., generated, transmitted, rendered, presented, confirmed, acknowledged, etc.). In an aspect, the control system 126 can determine whether one or more of the first command code and the second command code enables the controller 128 to control assigned functions related to a particular device. As an example, validation information can comprise providing prompts to a user to confirm whether a particular input resulted in a desired function being triggered on the device. As a further example, validation information can comprise an automated confirmation that the particular controller has been setup or coded to enable particular controls.

As an illustrative example, a user can select the manufacturer of a device to be controlled. Once the device manufacturer has been chosen, the user can be presented with a list of code indices the selected manufacturer supports. As an example, the device can be configured to present feedback (e.g., an audible sound, tactile, and/or visual feedback). Accordingly, the user can provide an input by engaging a button on a controller, for example, the "mute" button. As an example, each time the user presses the "mute" button, the control system 126 can transmit a command code or encoding for the associated "mute" function to the controller and the controller can transmit a signal to the device based upon the encoding. If the device or devices mute, then the encoding can be validated for the "mute" function of that particular device. Although this example focuses on "mute," any function or input can be used.

In an aspect, each of a plurality of code indices supports encodings for any number of device control functions or features. Accordingly, once the user has selected an index that mutes the device, the control system 126 can determine if the index is a full control function or partial control function match to other functions associated with the device. As an example, the control system 126 can prompt the user to test any number of functions to determine whether a particular function is supported by an code index or command code. In an aspect, the control system 126 can validate whether all tested functions worked. If the user provides a "Yes" or positive response, then the process can terminate. If the user provides a "No" or negative response, the user can be prompted to identify which functions do not work. In an aspect, using the information provided relating to the functions that are operative and the functions that are not operative, the control system 126 can determine a preferred or best match command code, command codes, or code index to implement.

In step 420, one or more of the validated first command code and the validated second command code can be associated with a control device. In an aspect, once a preferred or best match command code, command codes, or code index has been determined, a particular control device or devices can be configured to implement the preferred or best match command code, command codes, or code index.

Figure 5:
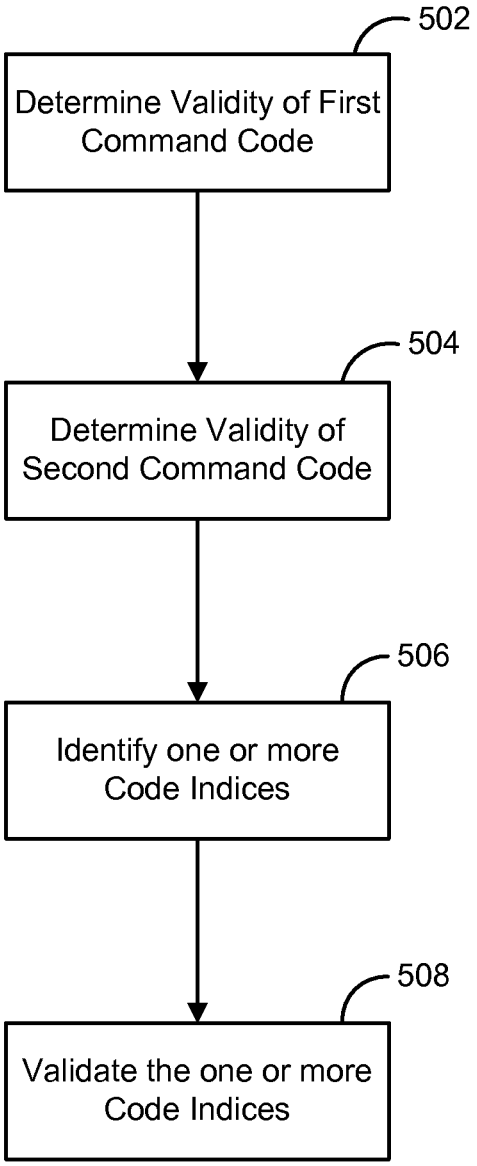
FIG. 5 is a flow chart of an exemplary method.

In an aspect, illustrated in FIG. 5, provided are methods that can be used to determine whether one or more control codes and/or indices of control codes are valid to enable control of a device from a controller. In step 502, validity of a first command code can be determined. In an aspect, the first command code can be evaluated to determine whether the first command code enables a controller to control a particular associated control function of a device. As an example, if the first command code is determined to enable an associated control function or feature of a device, the first command code can be determined to be operative and/or valid and can be classified as such. As a further example, if the first command code is determined to not enable an associated control function or feature of a device, the first command code can be determined to be non-operative and/or invalid and can be classified as such.

In step 504, validity of a second command code can be determined. In an aspect, the second command code can be evaluated to determine whether the second command code enables a controller to control a particular associated function of a device. As an example, if the second command code is determined to enable an associated control function or feature of a device, the second command code can be determined to be operative and/or valid and can be classified as such. As a further example, if the second command code is determined to not enable an associated control function or feature of a device, the second command code can be determined to be non-operative and/or invalid and can be classified as such.

In step 506, one or more index codes or code indices can be determined or identified. In an aspect, the one or more code indices can be determined based upon the presence of at least one of the first command code and the second command code. As an example, a code index can comprise one or more pre-defined command codes or encodings. As a further example, a code index can be classified based upon manufacturer or device type associated with a device to be controlled by the code index. In an aspect, one or more code indices can be determined by selecting a code index that includes one or more of the first command code and the second command code. In an aspect, one or more code indices can be determined by selecting a code index that excludes one or more of the first command code and the second command code. As an example, determining one or more index codes or code indices can comprise identifying, loading, transmitting, receiving, and/or analyzing the one or more code indices from a library. As a further example, the library can be associated with a particular manufacturer of a device.

In step 508, the one or more of the code indices determined can be validated (tested, evaluated, analyzed, etc.). In an aspect, an index code or code index can comprise a plurality of encodings or command codes for enabling a controller to control a particular device. As such, validating a code index can comprise testing one or more of the command codes comprised by the code index on a particular device. For example, a code index can comprise the first command code but not the second command code. Additionally, the code index can comprise a third command code for a function that has not been validated or tested. Accordingly, the code index, including each of the command codes comprised by the code index, can be tested to determine if the code index is valid for all available and/or required functions. If a code index is determined to be partially valid (e.g., a partial match), then partial match remediation can be implemented. For example, if a select code index is validated as a partial control match, supplemental validation information regarding one or more command codes can be requested in order to improve the percentage of enabled control functions.

Figure 6:
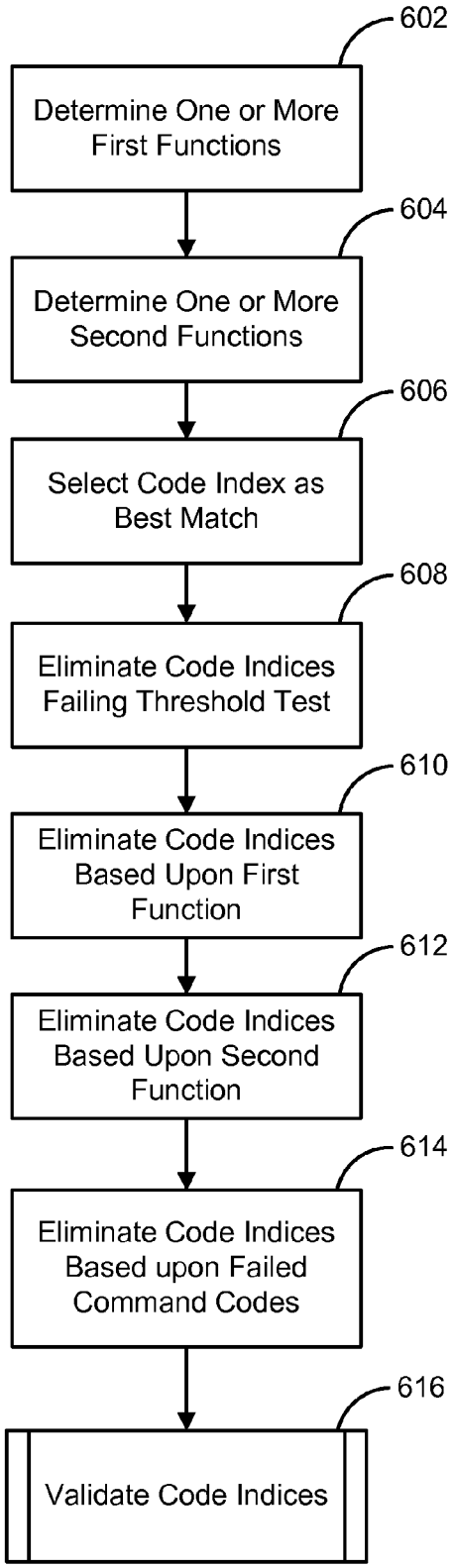
FIG. 6 is a flow chart of an exemplary method.

In an aspect, illustrated in FIG. 6, provided are methods for resolving partial matches between available control inputs on a controller and the associated control functions of a device. In step 602, one or more first functions (e.g., a first group of control functions) can be determined. In an aspect, the first group of control functions can comprise functions that are operative using a particular controller. As an example, the first group of control functions can comprise control functions and/or features that have been determined to be associated with valid or operative command codes. As a further example, the first group of control functions can comprise control functions and/or features that have been determined to be associated with invalid or non-operative command codes. In an aspect, the first group of control functions can be classified, organized, grouped, and/or stored.

In step 604, one or more second functions (i.e., a second group of control functions) can be determined. In an aspect, the second group of control functions can comprise functions that are non-operative using a particular controller. As an example, the second group of control functions can comprise control functions and/or features that have been determined to be associated with valid or operative command codes. As a further example, the second group of control functions can comprise control functions and/or features that have been determined to be associated with invalid or non-operative command codes. In an aspect, the second group of control functions can be classified, organized, grouped, and/or stored.

In step 606, an index code or code index can be selected. In an aspect, the control system 126 can select a code index based upon a presence and/or operation of one or more of the functions in the first group of control functions and/or the second group of control functions. In an aspect, the code index selected can be classified and/or designated as a preferred code index or a best match code index. As an example, a code index comprising at least one valid command code can be selected. As a further example, a code index that has been validated according to step 508 (FIG. 5) can be selected. In an aspect, a code index can be selected from a library and/or database comprising a plurality of code indices.

Figure 7:
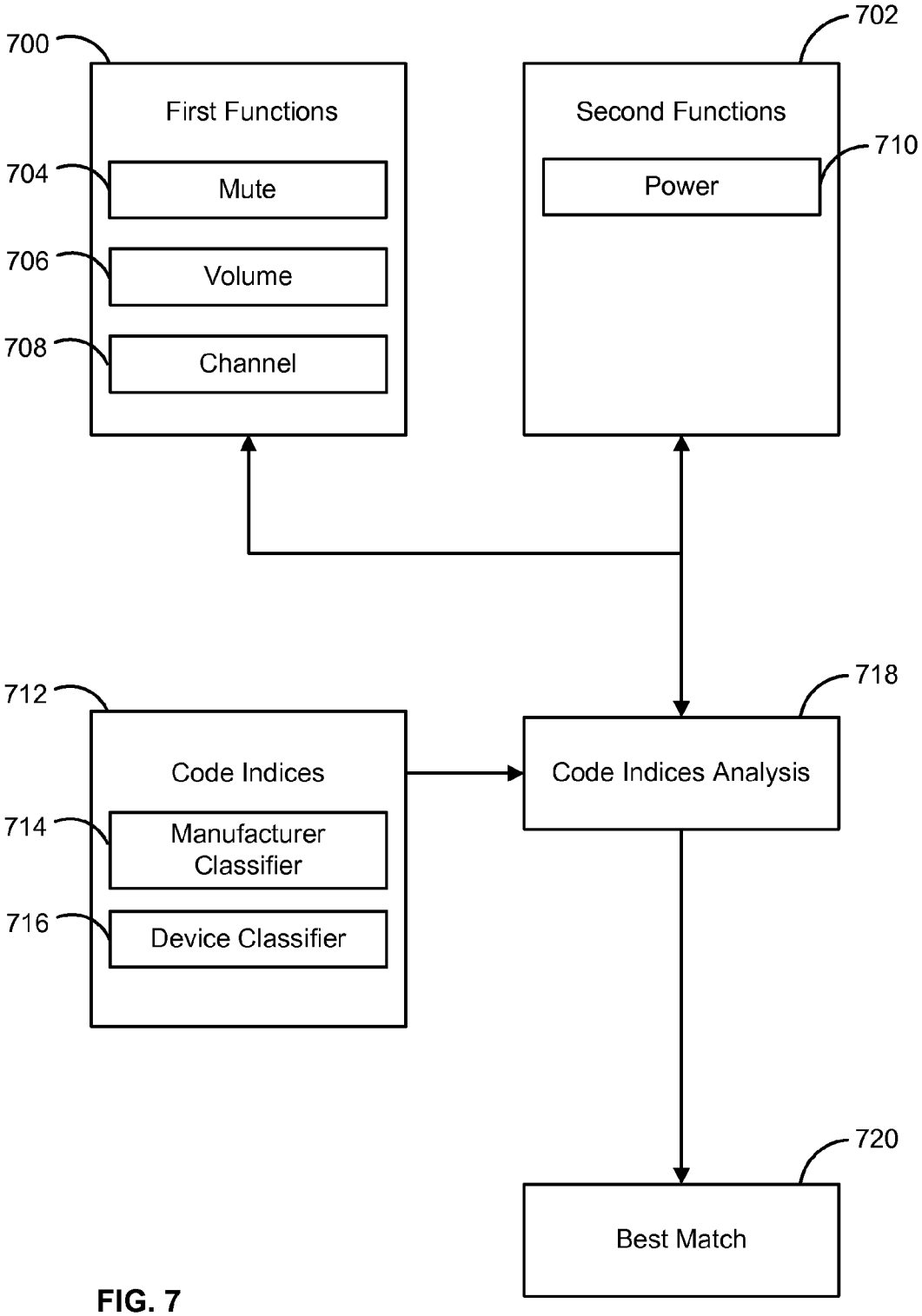
FIG. 7 is a block diagram of an exemplary data flow.

As an example only, FIG. 7 illustrates a block diagram of data blocks and a data flow. As an illustrative example, first functions 700 (e.g., data block, array, list, group, etc.) can comprise functions determined in step 602 (FIG. 6) and second functions 702 (e.g., data block, array, list, group, etc.) can comprise functions determined in step 604 (FIG. 6). Other functions and/or groups of functions can be included in first functions 700 and second function 702.

In an aspect, the first functions 700 can comprise control functions and/or features that have been determined to be associated with valid or operative command codes. As an example, valid control features may be determined to be mute 704, volume control 706, and channel control 708. In an aspect, the second functions 702 can comprise control functions and/or features that have been determined to be associated with invalid or non-operative command codes. As an example, an invalid control feature may be determined to be power 710. Any number of control features (and associated command codes) can be evaluated and classified as first functions 700 or second functions 702.

In an aspect, one or more code indices 712 can be stored in a database or storage medium. As an example, the code indices 712 can be classified, grouped and/or designated. As a further example, classifiers for the code indices 712 can comprise a manufacturer classifier 714 and a device classifier 716. In an aspect, the manufacturer classifier 714 can classify and/or designate one or more code indices as being associated with a particular manufacture of a device to be controlled. In an aspect, the manufacturer classifier 714 can classify and/or designate one or more code indices as being associated with a particular manufacture of a controller to be used for controlling a device. In an aspect, the device classifier 716 can classify and/or designate one or more code indices as being associated with a particular type or series of a device to be controlled. As an example, the device type can comprise a content device, a video device, an audio device, a recording device, a home security device, a communication device, etc. In an aspect, the manufacturer classifier 714 can classify and/or designate one or more code indices as being associated with a particular type or series of controller. As an example, the controller type can comprise a remote controller, a "universal" controller, an HDMI-CEC controller, a software-implemented controller, etc. The code indices and/or command codes can be classified and/or organized based on other classifiers, parameters, metrics, and the like.

In an aspect, one or more of the code indices 712 can be analyzed (at 718) to determine a select or best match code index (at 720). As an example, the control system 126 can analyze one or more code indices 712. As a further example, the one or more code indices can be processed using the methods disclosed herein to determine a best match code index.

Returning to FIG. 6, one or more code indices can be analyzed using a threshold or initial test. As an example, the threshold test can comprise validating an operation of a particular function associated with one or more of the code indices. In step 608, if a code index fails the threshold test or is determined to be invalid for a particular threshold function, the code index is eliminated as a candidate for best match. In certain aspects, eliminated code indices can be subsequently analyzed for best match candidacy and/or priority regardless of the threshold test. As an example, all code idices that fail to operate a 'mute' function can be eliminated as candidates for best match. Other functions can be used as the threshold function test.

In step 610, one or more code indices that do not comprise one or more command codes that are associated with first functions can be eliminated as best match candidates. As an example, the one or more code indices of a certain manufacture can be compared to the first functions to determine if the code indices comprise valid command codes. As a further example, one or more code indices associated with a particular device type can be compared to the first functions to determine if the code indices comprise valid command codes. In an aspect, if the one or more code indices do not comprise valid command codes, the one or more code indices can be eliminated as candidates for best match.

In step 612, one or more code indices comprising command codes that are associated with second functions can be eliminated as best match candidates. In an aspect, the eliminated code indices comprise invalid command codes and therefore are not enabled to control the second functions. As an example, the one or more code indices of a certain manufacturer can be compared to the second functions to determine if the code indices comprise invalid command codes. As a further example, one or more code indices associated with a particular device type can be compared to the second functions to determine if the code indices comprise invalid command codes.

In step 614, if the one or more code indices comprise invalid command codes, the one or more code indices can be eliminated as candidates for best match. In an aspect, the eliminated code indices comprise invalid command codes and therefore are not enabled to control the second functions. As an example, the one or more remaining code indices of a certain manufacture can be compared to the eliminated code indices to determine if the remaining code indices comprise invalid command codes. As a further example, one or more remaining code indices associated with a particular device type can be compared to the eliminated code indices to determine if the remaining code indices comprise invalid command codes.

In step 616, one or more code indices can be processed (e.g., validated) to determine a best match code index for implementation. In an aspect, one or more code indices that have not been eliminated can be processed and compared to other code indices to determine a best match code index to be implemented. As an example, the one or more remaining code indices to be processed can comprise each of the first functions. As such, in certain aspects, only the second functions need to be validated for the remaining code indices. However, any code indices can be processed to determine a best match.

Figure 8:
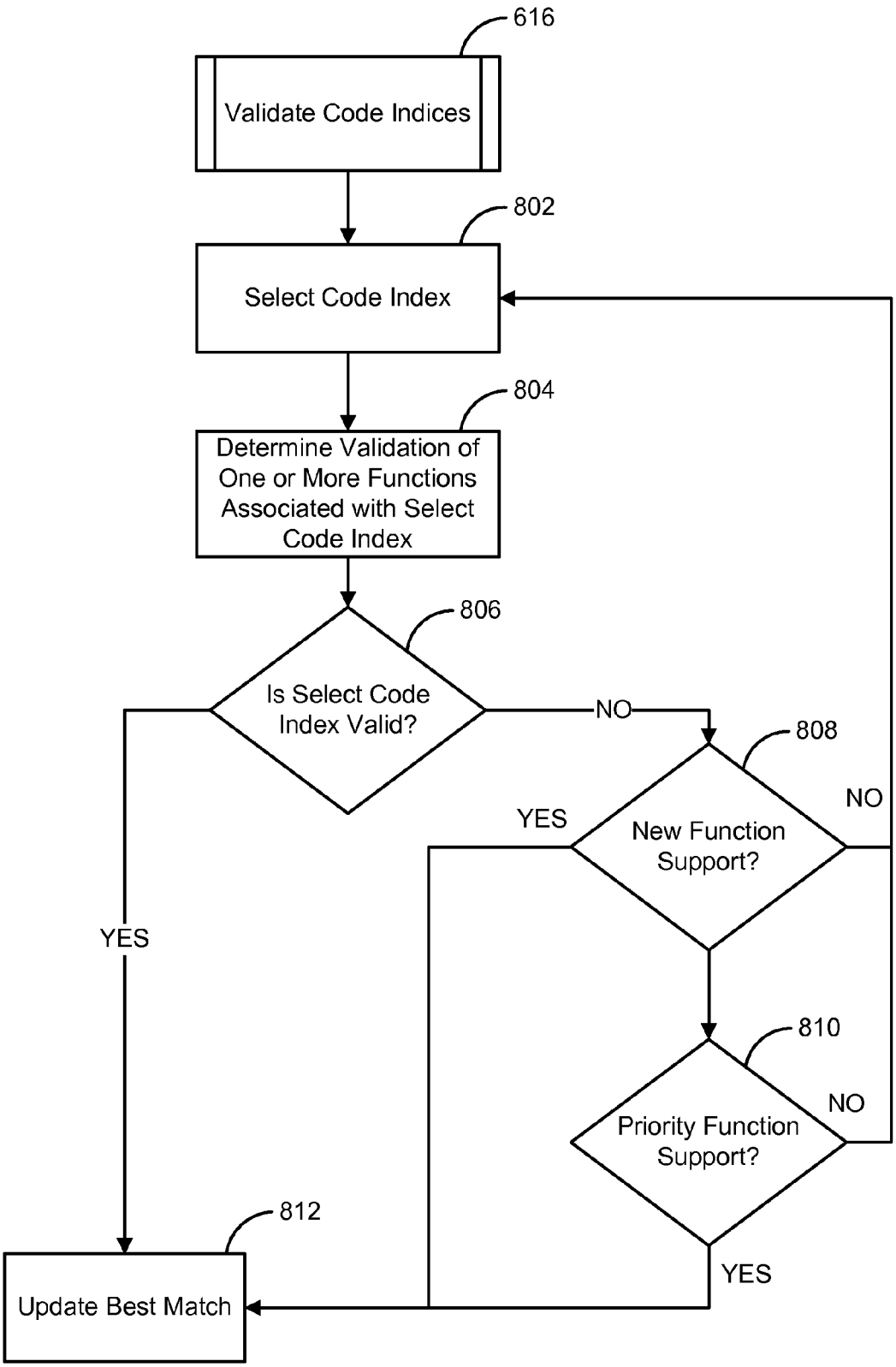
FIG. 8 is a flow chart of an exemplary method.

In an aspect, FIG. 8 illustrates a method for validating one or more index codes or code indices. As an example, the method illustrated in FIG. 8 can be implemented to process a plurality of code indices to determine a best match code index to be implemented for controlling a particular device. In step 802, a code index is selected for processing. As an example, the selected code index can be a remaining code index that was not eliminated by the method of FIG. 6.

In step 804, one or more command codes associated with the selected code index can be validated. In an aspect, a validation screen can be presented to a user to prompt the user to test the functions associated with the one or more command codes. As an example, volume control can be tested and the user can be prompted to confirm that the controller was able to increase and/or decrease an audible sound volume. As a further example, power control can be tested and the control system 126 can automatically determine if a device was powered on/powered off by the controller. In an aspect, one or more command codes can be validated automatically and/or with user feedback.

In step 806, one or more code indices can be validated. In an aspect, if one or more command codes of a particular code index are determined to be valid, the particular code index can be updated as the best match code index, at step 812. As an example, if a particular code index comprises more valid command codes than other code indices (e.g., the current best match code index), then the code index can be updated as the best match code index. As a further example, if a particular code index comprises a command code that is valid for a function (e.g., second function) that the current best match code index does not contain, the particular code index can be updated as the new best match code index.

In step 808, one or more code indices can be analyzed to determine if the one or more code indices comprise new function support and/or command codes for functions that are not currently supported by the implemented code index. If an code index comprises new function support, the code index (or particular command codes of the code index) can be updated as the best match. For example, if the current code index can control mute functions, volume functions, and channel functions and a second code index can only control power functions, the command code from the second code index can be implemented to update the best match code index, at step 812.

In step 810, one or more code indices can be analyzed to determine if the one or more code indices comprise priority function support and/or priority command codes for functions that are not currently supported by the implemented code index. If a code index comprises priority function support, the code index (or particular command codes of the code index) can be updated as the best match. For example, a first code index can control mute functions, volume functions, and channel functions, and a second code index can control volume controls, channel controls, and guide navigation functions. If guide navigation has been predefined with a higher priority than the mute function, then the command code from the second code index can be implemented to update the best match code index. In an aspect, a user and or manufacturer can prioritize which functions are most important in order to give the user the best partial match. For example, prioritization can occur during the development stage of a device, during initial device set-up, during device operation, and the like.

In an aspect, once a selected code index is processed, the method can return to step 802 and select another code index for processing. As an example, if a code index is validated as a full match or otherwise exceeds some pre-defined threshold for control features, then the code index can be implemented and the process ended. As new code indices and/or command codes are received by the control system 126, the method of FIG. 8 can be implemented to determine if the current best match should be updated. By way of example, new code indices and/or command codes can be received through manufacturer updates, new versioning, new releases, updated databases, new code sources, and the like.

In an aspect, control functions or features that are not supported by the best match code index can be identified and/or transmitted to another control device. For example, functions not support by the code index for a television can be configured to be controlled by a set-top box or terminal. As such, a single controller can still operate all requisite control functions using more than one device to implement the actual functions. In an aspect, television logic can implement power controls and volume control, while a terminal or other user device implements channel control from the same controller. In an aspect, CEC and other communication means can be merged. As an example, a first control (e.g. volume control) can be transmitted to the CT 120 via RF, then via CEC to the display device 121, while other commands are transmitted via IR. Any number of commands can be transmitted over any number of communication means.

Figure 9:
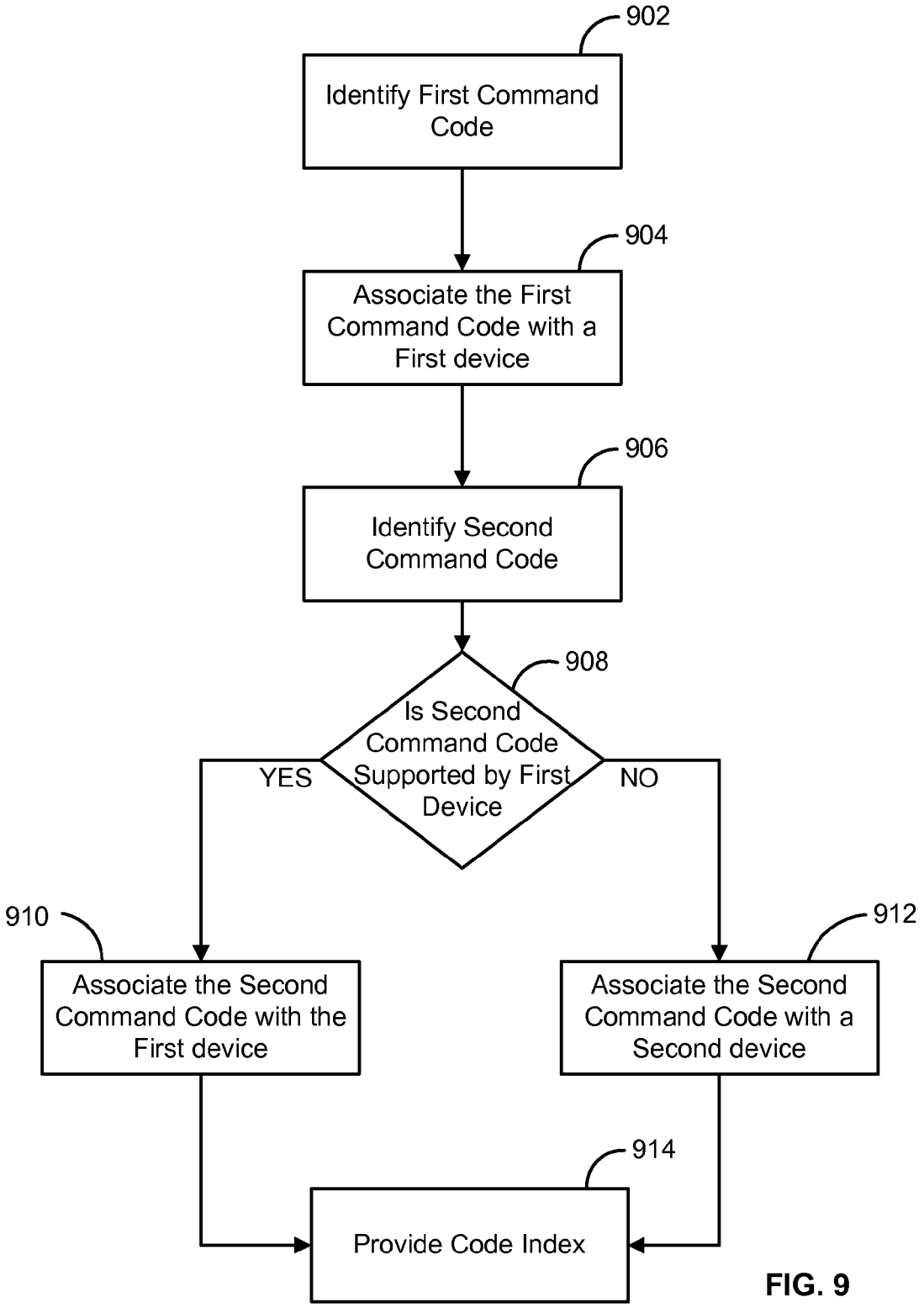
FIG. 9 is a flow chart of an exemplary method.

FIG. 9 illustrates an exemplary method for managing control functions and/or features of one or more devices. In step 902, a first command code can be identified or selected. As an example, the first command code can be identified by validating whether the first command code enables control of an associated control function of a particular device.

In step 904, the first command code can be associated with a first device. As an example, the first command code can be associated with the first device based upon a validation of the operation of the command code with the first device. As a further example, the first command code can be validated as a code that instructs the first device to implement a particular function.

In step 906, a second command code can be identified or selected. As an example, the second command code can be identified by validating whether the second command code enables control of an associated control function of a particular device. In step 908, the control system 126 can determine whether the second command code is supported by the first device.

In step 910, if the first device supports the second command code, the second command code can be associated with the first device. In step 912, if the first device does not support the second command code, the second command code can be tested with a second device. If the second device supports the second command code, the second command code can be associated with the second device, such that the second device will implement the functions associated with the second command code.

In step 914, a code index can be provided including one or more of the first command code and the second command code. As such, the code index can implemented by a particular control device to communicate with one or more content devices in order to control associated control functions.

In an aspect, various functions can be supported by one or more devices from a single controller. For example, volume control and power control can be transmitted to a display device and mute can be transmitted to a user device in communication with the display device. As such, the user device can implement a mute control over the display device.

In an aspect, an informational message can be presented to a user. For example, if input/select control is not supported by the best match code index, the controllable device and/or controller can present information to the user relating to the operative and non-operative functions. As an example, a menu option can comprise a listing of operative and non-operative functions, allowing the user to identify which functions are supported for a particular device.

In an aspect, diagnostic information can be transmitted to a remote computing device and/or the central location 101 to notify a service provider and/or manufacture of the operative and/or non-operative functions. Accordingly, an database developer and/or provider can update the command codes.

Figure 10:
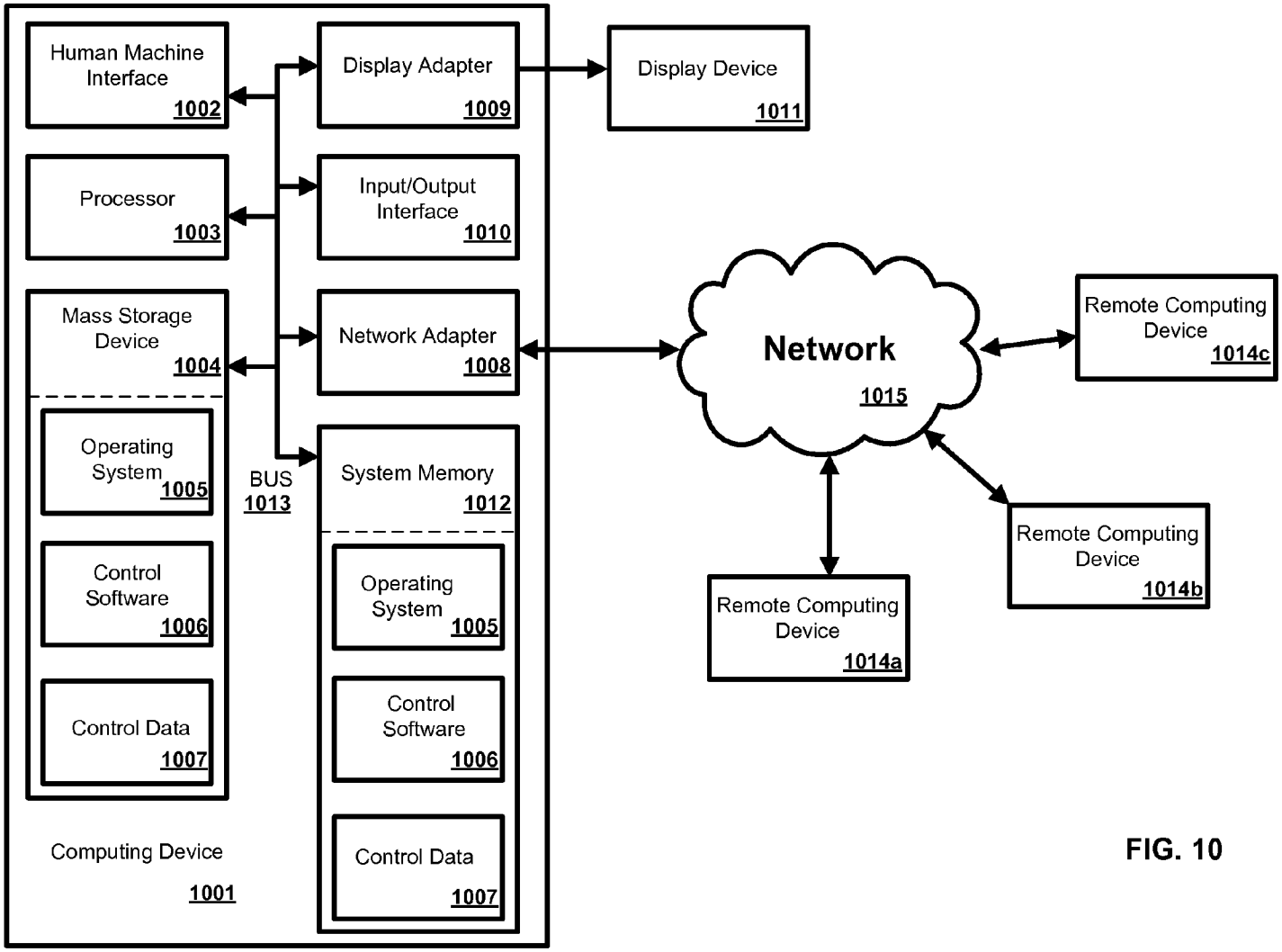
FIG. 10 is a block diagram of an exemplary computing device.

In an exemplary aspect, the methods and systems can be implemented on a computing system such as computing device 1001 as illustrated in FIG. 10 and described below. By way of example, one or more of the CT 120, the user device 124, and the control system 126 of FIGS. 1-2A can comprise a computing device as illustrated in FIG. 10. Similarly, the methods and systems disclosed can utilize one or more computers to perform one or more functions in one or more locations. FIG. 10 is a block diagram illustrating an exemplary operating environment for performing the disclosed methods. One skilled in the art will appreciate that this is a functional description and that the respective functions can be performed by software, hardware, or a combination of software and hardware. This exemplary operating environment is only an example of an operating environment and is not intended to suggest any limitation as to the scope of use or functionality of operating environment architecture. Neither should the operating environment be interpreted as having any dependency or requirement relating to any one or combination of components illustrated in the exemplary operating environment.

The present methods and systems can be operational with numerous other general purpose or special purpose computing system environments or configurations. Examples of well known computing systems, environments, and/or configurations that can be suitable for use with the systems and methods comprise, but are not limited to, personal computers, server computers, laptop devices, and multiprocessor systems. Additional examples comprise set top boxes, programmable consumer electronics, network PCs, minicomputers, mainframe computers, distributed computing environments that comprise any of the above systems or devices, and the like.

The processing of the disclosed methods and systems can be performed by software components. The disclosed systems and methods can be described in the general context of computer-executable instructions, such as program modules, being executed by one or more computers or other devices. Generally, program modules comprise computer code, routines, programs, objects, components, data structures, etc. that perform particular tasks or implement particular abstract data types. The disclosed methods can also be practiced in grid-based and distributed computing environments where tasks are performed by remote processing devices that are linked through a communications network. In a distributed computing environment, program modules can be located in both local and remote computer storage media including memory storage devices.

Further, one skilled in the art will appreciate that the systems and methods disclosed herein can be implemented via a general-purpose computing device in the form of a computer 1001. The components of the computer 1001 can comprise, but are not limited to, one or more processors or processing units 1003, a system memory 1012, and a system bus 1013 that couples various system components including the processor 1003 to the system memory 1012. In the case of multiple processing units 1003, the system can utilize parallel computing.

The system bus 1013 represents one or more of several possible types of bus structures, including a memory bus or memory controller, a peripheral bus, an accelerated graphics port, and a processor or local bus using any of a variety of bus architectures. By way of example, such architectures can comprise an Industry Standard Architecture (ISA) bus, a Micro Channel Architecture (MCA) bus, an Enhanced ISA (EISA) bus, a Video Electronics Standards Association (VESA) local bus, an Accelerated Graphics Port (AGP) bus, and a Peripheral Component Interconnects (PCI), a PCI-Express bus, a Personal Computer Memory Card Industry Association (PCMCIA), Universal Serial Bus (USB) and the like. The bus 1013, and all buses specified in this description can also be implemented over a wired or wireless network connection and each of the subsystems, including the processor 1003, a mass storage device 1004, an operating system 1005, control software 1006, control data 1007, a network adapter 1008, system memory 1012, an Input/Output Interface 1010, a display adapter 1009, a display device 1011, and a human machine interface 1002, can be contained within one or more remote computing devices 1014*a,b,c* at physically separate locations, connected through buses of this form, in effect implementing a fully distributed system.

The computing device 1001 typically comprises a variety of computer readable media. Exemplary readable media can be any available media that is accessible by the computing device 1001 and comprises, for example and not meant to be limiting, both volatile and non-volatile media, removable and non-removable media. The system memory 1012 comprises computer readable media in the form of volatile memory, such as random access memory (RAM), and/or non-volatile memory, such as read only memory (ROM). The system memory 1012 typically contains data such as control data 1007 and/or program modules such as operating system 1005 and control software 1006 that are immediately accessible to and/or are presently operated on by the processing unit 1003.

In another aspect, the computing device 1001 can also comprise other removable/non-removable, volatile/non-volatile computer storage media. By way of example, FIG. 10 illustrates a mass storage device 1004 which can provide non-volatile storage of computer code, computer readable instructions, data structures, program modules, and other data for the computing device 1001. For example and not meant to be limiting, a mass storage device 1004 can be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Optionally, any number of program modules can be stored on the mass storage device 1004, including by way of example, an operating system 1005 and control software 1006. Each of the operating system 1005 and control software 1006 (or some combination thereof) can comprise elements of the programming and the control software 1006. Control data 1007 can also be stored on the mass storage device 1004. Control data 1007 can be stored in any of one or more databases known in the art. Examples of such databases comprise, DB2®, Microsoft® Access, Microsoft® SQL Server, Oracle®, mySQL, PostgreSQL, and the like. The databases can be centralized or distributed across multiple systems.

In another aspect, the user can enter commands and information into the computing device 1001 via an input device (not shown). Examples of such input devices comprise, but are not limited to, a keyboard, pointing device (e.g., a "mouse"), a microphone, a joystick, a scanner, visual systems such as Microsoft's Kinect, audio systems that process sound such as music or speech, a traditional silver remote control, tactile input devices such as gloves, touch-responsive screen, body coverings, and the like These and other input devices can be connected to the processing unit 1003 via a human machine interface 1002 that is coupled to the system bus 1013, but can be connected by other interface and bus structures, such as a parallel port, game port, an IEEE 1394 Port (also known as a Firewire port), a serial port, or a universal serial bus (USB).

In yet another aspect, a display device 1011 can also be connected to the system bus 1013 via an interface, such as a display adapter 1009. It is contemplated that the computer 1001 can have more than one display adapter 1009 and the computing device 1001 can have more than one display device 1011. For example, a display device can be a monitor, an LCD (Liquid Crystal Display), or a projector. In addition to the display device 1011, other output peripheral devices can comprise components such as speakers (not shown) and a printer (not shown) which can be connected to the computing device 1001 via Input/Output Interface 1010. Any step and/or result of the methods can be output in any form to an output device. Such output can be any form of visual representation, including, but not limited to, textual, graphical, animation, audio, tactile, and the like. The display 1011 and computing device 1001 can be part of one device, or separate devices.

The computing device 1001 can operate in a networked environment using logical connections to one or more remote computing devices 1014*a,b,c*. By way of example, a remote computing device can be a personal computer, portable computer, a smartphone, a server, a router, a network computer, a peer device or other common network node, and so on. Logical connections between the computing device 1001 and a remote computing device 1014*a,b,c* can be made via a network 1015, such as a local area network (LAN) and a general wide area network (WAN). Such network connections can be through a network adapter 1008. A network adapter 1008 can be implemented in both wired and wireless environments. Such networking environments are conventional and commonplace in dwellings, offices, enterprise-wide computer networks, intranets, and the Internet. Furthermore, the computing device 1001 can communicate information to one or more of the remote computing devices 1014*a,b,c* for data analysis, pattern recognition, and control encoding, for example. In an aspect, the control system 126 can communicate information to one or more of the remote computing devices 1014*a,b,c* (e.g., data center) for one or more of analyzing the alert to determine an appropriate response, aggregating a plurality of received alerts, and filtering a plurality of received alerts.

For purposes of illustration, application programs and other executable program components such as the operating system 1005 are illustrated herein as discrete blocks, although it is recognized that such programs and components reside at various times in different storage components of the computing device 1001, and are executed by the data processor(s) of the computer. An implementation of control software 1006 can be stored on or transmitted across some form of computer readable media. Any of the disclosed methods can be performed by computer readable instructions embodied on computer readable media. Computer readable media can be any available media that can be accessed by a computer. By way of example and not meant to be limiting, computer readable media can comprise "computer storage media" and "communications media." "Computer storage media" comprise volatile and non-volatile, removable and non-removable media implemented in any methods or technology for storage of information such as computer readable instructions, data structures, program modules, or other data. Exemplary computer storage media comprises, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

In an aspect, systems and methods of the present disclosure can comprise an algorithm or other technique to determine the severity of the event and to notify appropriate personnel to investigate accordingly. As an example, an algorithm can evaluate the event based on severity and can assign a high, medium, or low designation.

The methods and systems can employ Artificial Intelligence techniques such as machine learning and iterative learning. Examples of such techniques include, but are not limited to, expert systems, case based reasoning, Bayesian networks, behavior based AI, neural networks, fuzzy systems, evolutionary computation (e.g. genetic algorithms), swarm intelligence (e.g. ant algorithms), and hybrid intelligent systems (e.g. Expert inference rules generated through a neural network or production rules from statistical learning).

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A method comprising:

receiving, by a control device, a first input relating to a first function;

requesting, by the control device, a first command code associated with the first function in response to receiving the first input;

receiving, by the control device, the first command code, from a first device, wherein the first command code is associated with a first code index;

transmitting, by the control device, a first signal based upon the first command code to a second device;

transmitting, by the control device, a first confirmation that the first signal triggered the first function on the second device;

receiving, by the control device, a second input relating to a second function;

requesting, by the control device, a second command code associated with the second function in response to receiving the second input;

receiving, by the control device, the second command code, from the first device, wherein the second command code is associated with a second code index;

transmitting, by the control device, a second signal based upon the second command code to the second device; and transmitting, by the control device, a second confirmation that the second signal triggered the second function on the second device, wherein the first command code and the second command code are validated by the first device based on the first confirmation and the second confirmation and, wherein receiving a third input relating to the first function on the control device causes a third signal based upon the first command code to be transmitted to the second device, and wherein receiving a fourth input relating to the second function on the control device causes a fourth signal based upon the second command code to be transmitted to the second device.

2. The method of claim 1, wherein one or more of the first function or the second function comprises one or more of a display control function, a content control function, a receiver control function, or a user device control function.

3. The method of claim 1, wherein one or more of the first command code or the second command code is a command encoding for wireless control of a user device.

4. The method of claim 1, wherein one or more of the first command code or the second command code is received by one or more of radio frequency communication or infrared communication.

5. The method of claim 1, wherein one or more of the first signal or the second signal is one or more of an infrared signal or a radio frequency signal.

6. The method of claim 1, further comprising storing, by the control device, one or more of the validated first command code or the validated second command code on the control device.

7. A method comprising:

receiving, by a computing device, validation information regarding validity of a plurality of first command codes from a control device;

identifying, by the computing device, a code index based upon the received validation information;

determining, by the computing device, the code index is a partial function match wherein at least one of the plurality of first command codes is valid for a first function in the code index and none of the plurality of first command codes is valid for a second function in the code index, the at least one of the plurality of first command codes being valid based on a triggering of the first function in response to the at least one of the plurality of first command codes as indicated in the received validation information;

receiving, by the computing device, supplemental validation information regarding validity of a second command code from the control device;

determining, by the computing device, the second command code is valid for the second function based on a triggering of the second function in response to the second command code as indicated in the supplemental validation information; and transmitting, by the computing device, the code index and the second command code to the control device to associate the first function with the code index and the second function with the second command code.

8. The method of claim 7, wherein the code index is identified from a library associated with a particular manufacturer of a user device.

9. The method of claim 7, further comprising determining, by the computing device, that the code index is a preferred index code of one or more code indices.

10. The method of claim 9, wherein determining the preferred code index comprises prioritizing the one or more code indices.

11. The method of claim 10, wherein the one or more code indices are prioritized based upon a pre-defined hierarchy of functions associated with one or more of the plurality of first command codes or the second command code.

12. The method of claim 7, wherein the code index is identified based upon a presence of one or more valid command codes.

13. The method of claim 7, wherein one or more of the validation information or the supplemental validation information comprises information relating to one or more prioritized control functions of a user device to be controlled by the control device.

14. A method comprising:

determining, by a computing device, a first command code is associated with a first control function executable on a first user device based on a first confirmation indicating a triggering of the first control function on the first user device;

associating, by the computing device, the first command code with the first user device for executing the first control function;

determining, by the computing device, a second command code is associated with a second control function that is not executable on the first user device;

determining, by the computing device, that the second control function is executable on a second user device;

associating, by the computing device, the second command code with the second user device for executing the second control function; and transmitting, by the computing device, a code index comprising the first command code and the second command code to a control device to associate the code index with the first control function and the second control function.

15. The method of claim 14, wherein one or more of the first command code or the second command code is associated with one or more of a display control function, a content control function, a receiver control function, or a user device control function.

16. The method of claim 14, wherein the first command code is a command encoding for wireless control of the first user device.

17. The method of claim 14, wherein one or more of the first command code or the second command code is received by one or more of radio frequency communication or infrared communication.

18. The method of claim 1, wherein the first device or the second device comprises a television, a receiver, or a set-top box.

19. The method of claim 7, wherein the control device comprises a remote control device.

20. The method of claim 14, wherein the control device comprises a remote control device, and wherein the first user device or the second user device comprise a television, a receiver, or a set-top box.

* * * * *